US006523728B2

(12) United States Patent
Lee

(10) Patent No.: US 6,523,728 B2
(45) Date of Patent: Feb. 25, 2003

(54) PVC CAP PACKAGING INSERT

(75) Inventor: Razgo Lee, Diamond Bar, CA (US)

(73) Assignee: Otto International, Inc., Ontario, CA (US)

( * ) Notice: Subject to any disclaimer, the term of this patent is extended or adjusted under 35 U.S.C. 154(b) by 0 days.

(21) Appl. No.: 09/815,110

(22) Filed: Mar. 22, 2001

(65) Prior Publication Data

US 2002/0133866 A1 Sep. 26, 2002

(51) Int. Cl.[7] ..... D06C 15/00
(52) U.S. Cl. ..... 223/84; 223/24; 223/12
(58) Field of Search ..... 223/84, 24, 12

(56) References Cited

U.S. PATENT DOCUMENTS 5,725,134 A * 3/1998 Weltge ..... 223/24
5,884,335 A * 3/1999 Whittaker ..... 2/195.5
5,987,649 A 11/1999 Robertson ..... 2/195

* cited by examiner

*Primary Examiner*—John J. Calvert
*Assistant Examiner*—James G. Smith
(74) *Attorney, Agent, or Firm*—Brett L. Halperin; Chan Law Group LC

(57) ABSTRACT

This invention satisfies a long felt need to protect a typical baseball type cap from the crushing forces often associated with shipping and packaging. This invention incorporates the not previously used idea of a half-crown or full-crown insert to support the cap from underneath against crushing forces occurring during shipping which tend to make an unsupported hat have a sloppy, wrinkled and undesirable appearance. The insert is retained inside the baseball type cap by tucking it into or around the sweatband. The industry has typically used outer rigid packaging covers to protect the cap during shipping and packaging. While these covers protect the cap from crushing forces, they do not support the crown portion from underneath. An underneath supporting insert will force the cap to retain its shape for long periods of time and can be used by the retail purchaser to retain the cap's shape when not in use.

6 Claims, 3 Drawing Sheets

PVC CAP PACKAGING INSERT

BACKGROUND OF THE INVENTION

1. Field of the Invention

The present invention relates to an insert for a baseball type cap installed inside the baseball type cap during packaging and shipping that serves to retain the cap's shape against crushing forces. A typical baseball type cap includes a crown portion and a visor portion connected to the front of the crown portion.

2. Description of Related Art

Visored or baseball type caps are well known in the art and come in many configurations. They include a hemispherical crown portion to fit onto a wearer's head and a visor or bill portion attached to the front of the hemispherical crown portion.

A baseball type cap is susceptible to crushing forces during packaging and shipping. The effect on an unprotected hat is that it tends to collapse inwardly resulting in a sloppy, wrinkled and undesirable appearance. The industry has typically used outer rigid packaging covers to protect the cap during shipping and packaging. While these covers protect the cap from crushing forces, they do not support the crown portion from underneath. An underneath supporting insert will force the cap to retain its shape for long periods of time and can be used by the retail purchaser to retain the cap's shape when not in use.

The present invention can be distinguished from U.S. Pat. No. 5,987,649, a cap insert. U.S. Pat. No. 5,987,649 discloses "a cap insert comprises an elongated sheet which is flexible but sufficiently rigid for use as a shaping insert in a baseball type cap. The sheet is substantially planar in a relaxed state and includes a central portion, opposing tapered portions, and opposing leg portions. The sheet fits inside a baseball type cap around the sweatband, and successfully returns an old baseball type cap to its proper shape." The present invention incorporates the distinction of reusable insert conceived to prevent crushing or wrinkling of the cap during shipping and packaging. It is shaped and sized to follow the inner surface contours of the front portion of a baseball type cap crown. On the other hand, the U.S. Pat. No. 5,987,649 insert is flat and is used to restore an "old cap" to wearable condition. The present invention is inserted into or around the cap sweatband and not just around it like the U.S. Pat. No. 5,987,649 insert. The flat insert of the U.S. Pat. No. 5,987,649 would give no support to a baseball type cap crown during shipping.

An objective of the present invention is to overcome the non-underneath support disadvantages of the prior art by providing a baseball type cap insert, which supports the hemispherical crown portion against crushing during shipping and packaging.

Its is also an objective of the present invention to provide an insert which will maintain the baseball type cap's shape from the time of manufacture through shipping and packaging, retail sale and into extended and extensive cap use by the consumer.

It is still another important objective of the present invention is to provide an insert which is readily and inexpensively manufactured.

SUMMARY OF THE INVENTION

The invention is a cap packaging insert. The cap packaging insert includes a supporting, sufficiently rigid, partial crown portion shaped and sized to follow the inner surface contours of the front portion of a baseball type cap crown. The cap packaging insert fits within the front portion of the baseball type cap crown. It is retained within the baseball type cap by inserting it into or around the baseball type cap sweatband. During packaging and shipping the cap packaging insert retains the shape of the front portion of the baseball type cap crown. The supporting, sufficiently rigid, partial crown portion has an inner surface and an outer surface, a lower peripheral edge and an aft peripheral edge.

In another variation on the invention the supporting, sufficiently rigid, partial crown portion can be fabricated from plastic, acrylic, polyvinyl chloride (PVC), polyethylene terephthalate (PET), polystyrene (PS), propylene and poly propylene (PP), or cardboard.

Yet another variation on the invention uses an injection mode as a means to manufacture the supporting, sufficiently rigid, partial crown portion.

Still another variation on the invention uses a press mode as a means to manufacture the supporting, sufficiently rigid, partial crown portion.

The cap packaging insert, in another version of the invention, includes a supporting, sufficiently rigid, crown portion shaped and sized to follow the inner surface contours of the baseball type cap crown. The cap packaging insert fits within the baseball type cap crown portion. It is retained by inserting it into or around the baseball type cap sweatband. During packaging and shipping, the cap packaging insert retains the shape of the baseball type cap crown. The supporting, sufficiently rigid, crown portion has an inner surface and an outer surface, and a lower peripheral edge. The lower peripheral edge has a circumferential linear extent of a first predetermined length.

In another variation on this form of the invention the supporting, sufficiently rigid, crown portion can be fabricated from plastic, acrylic, polyvinyl chloride (PVC), polyethylene terephthalate (PET), polystyrene (PS), propylene and poly propylene (PP), or cardboard.

Yet another variation on this form of the invention uses an injection mode as a means to manufacture the supporting, sufficiently rigid, crown portion.

Still another variation on this form of the invention uses a press mode as a means to manufacture the supporting, sufficiently rigid, crown portion.

The present invention provides underneath support of the crown portion of a baseball type cap against crushing forces encountered during shipping and packaging and thus overcomes the non-underneath support disadvantages of the prior art.

The present invention also satisfies an invention objective by providing an insert, which will maintain the baseball type cap's shape from the time of manufacture through shipping and packaging, retail sale and into extended and extensive cap use by the consumer.

The present invention also satisfies the invention objective to provide an insert that is readily and inexpensively manufactured.

DETAILED DESCRIPTION

Figure 1:
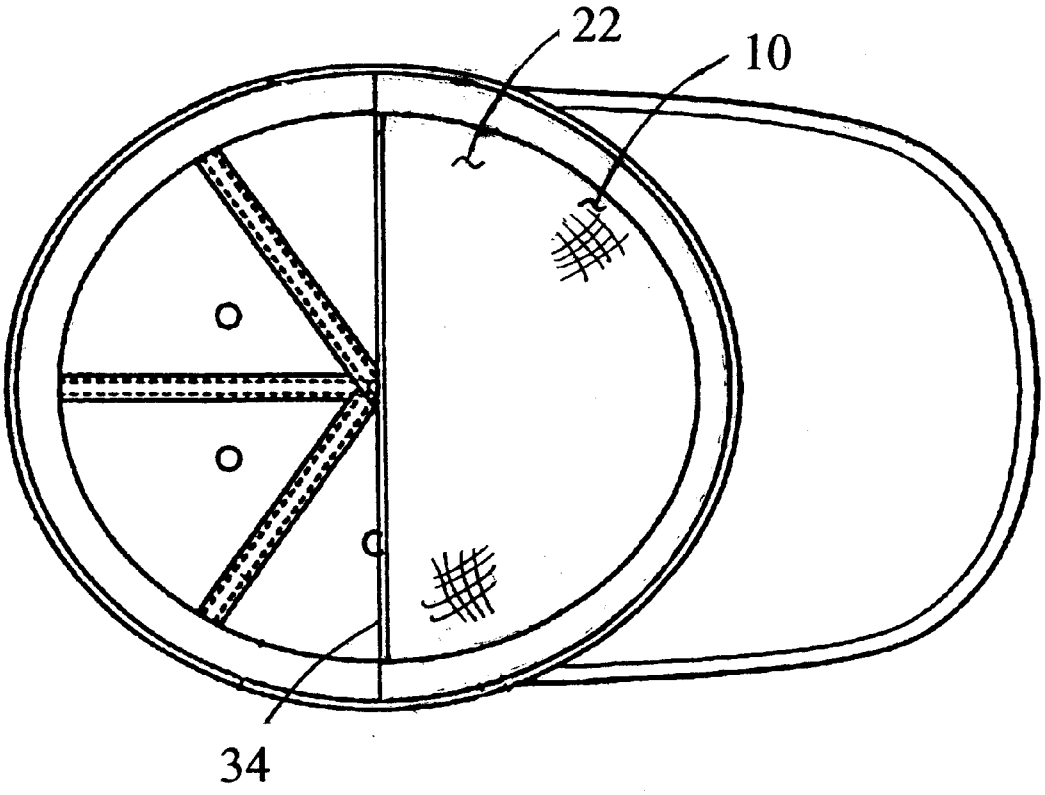
FIG. 1 is a plan view from the bottom looking upwards into the inside of the cap with a rigid partial crown portion cap packaging insert installed in the shipping and packaging position.
Figure 2:
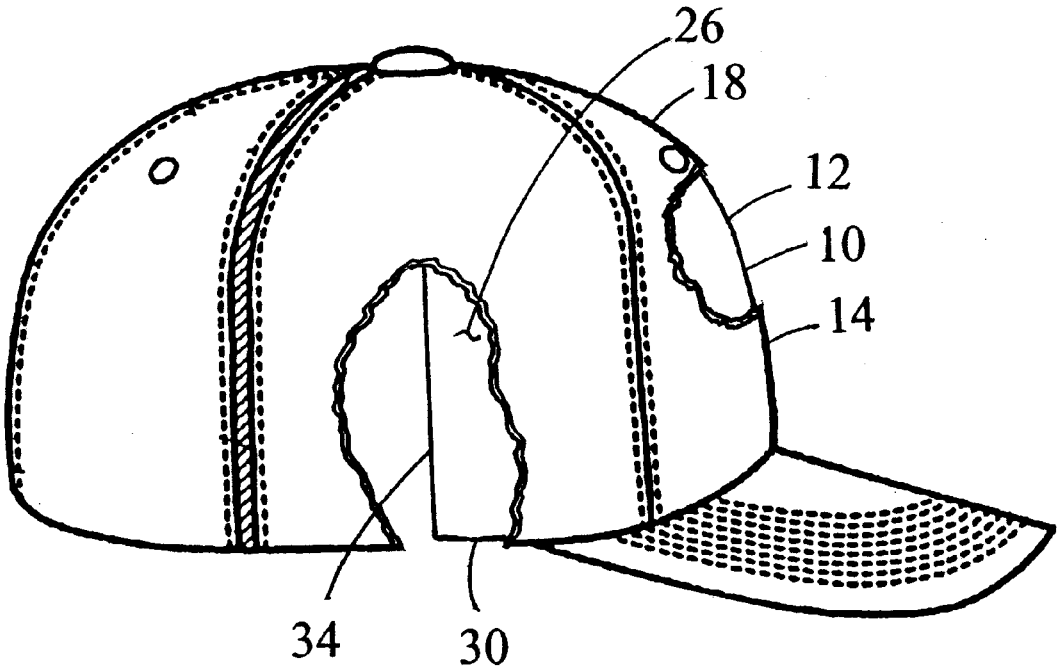
FIG. 2 is a side view of a baseball type cap with a rigid partial crown portion cap packaging insert installed in the shipping and packaging position.
Figure 3:
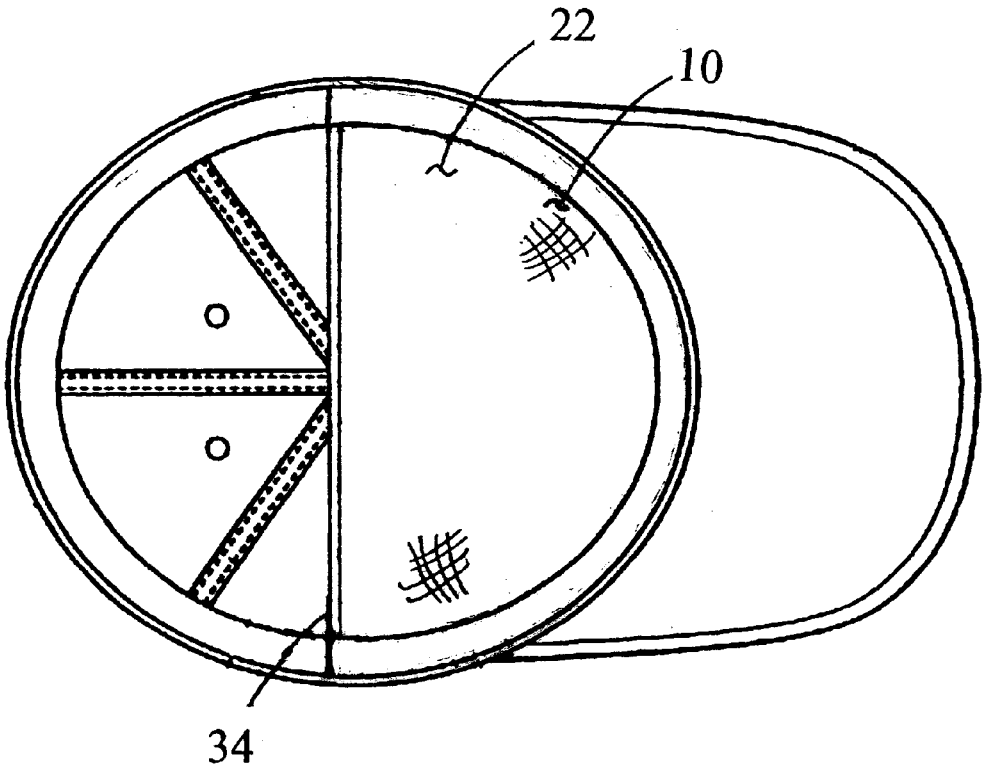
FIG. 3 is a plan view from the bottom looking upwards into the inside of the cap with a rigid greater part of the crown portion cap packaging insert installed in the shipping and packaging position.
Figure 4:
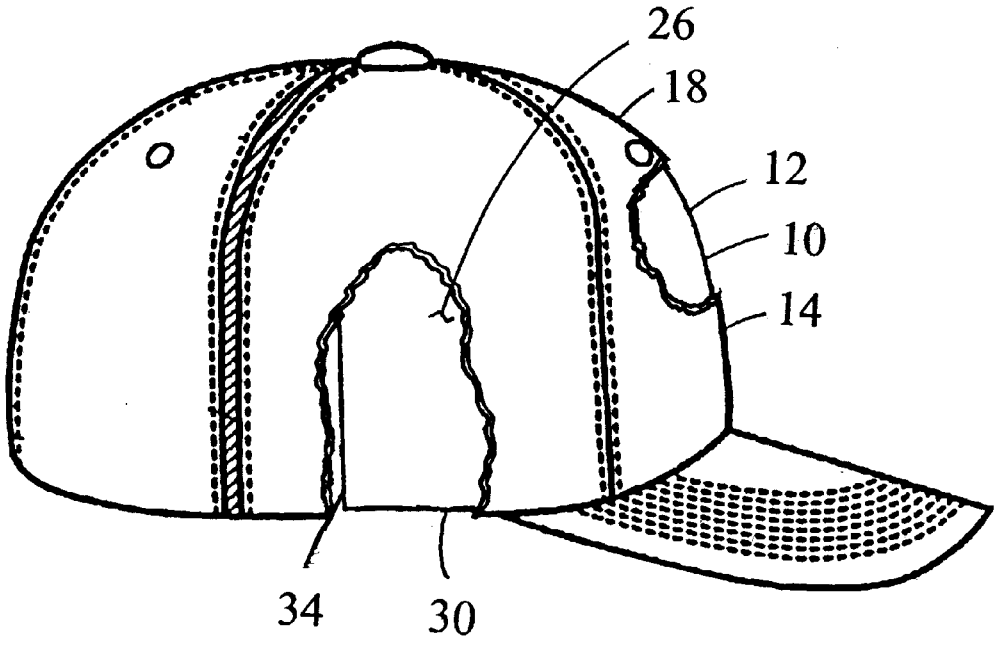
FIG. 4 is a side view of a baseball type cap with a rigid greater part of the crown portion cap packaging insert installed in the shipping and packaging position.
Figure 5:
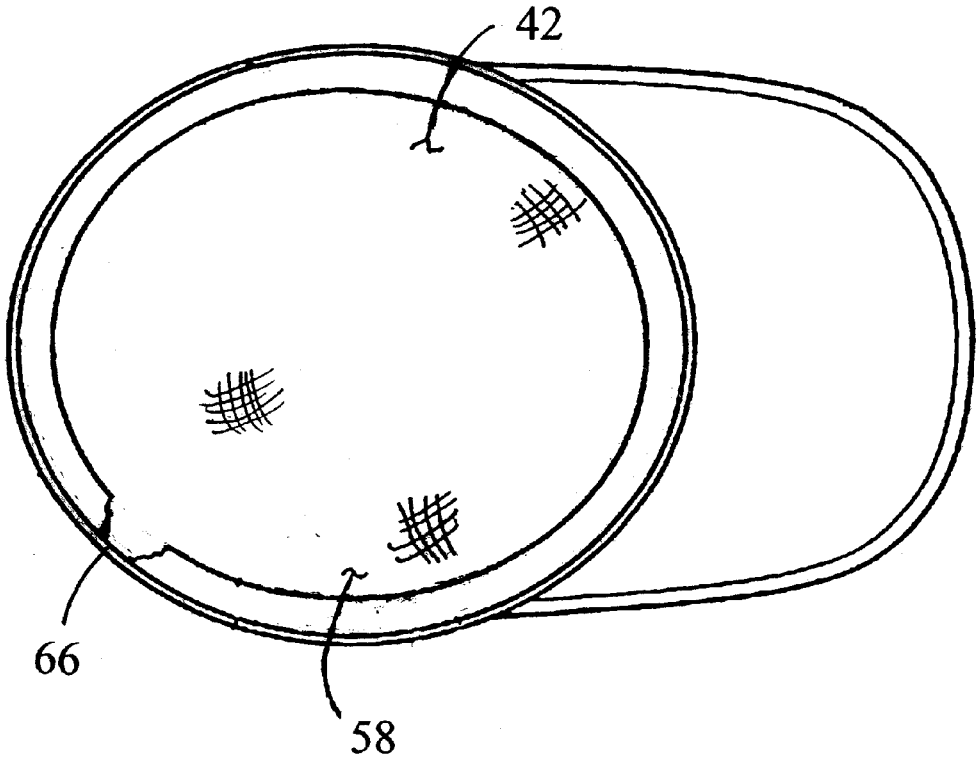
FIG. 5 is a plan view from the bottom looking upwards into the inside of the cap with the hemispherical cap packaging insert in the shipping and packaging position.
Figure 6:
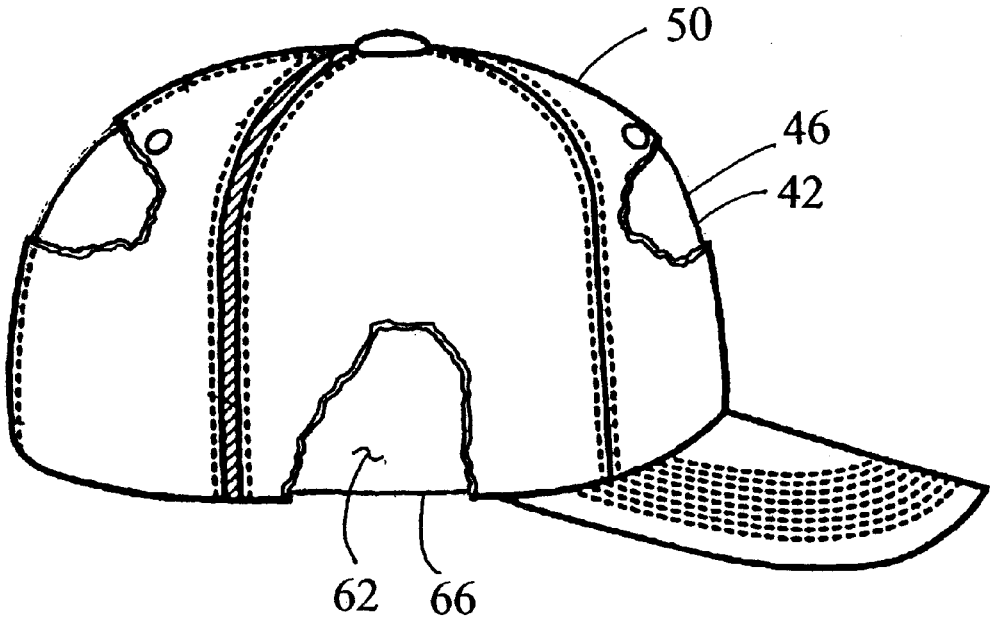
FIG. 6 is a side view of a baseball type cap with the hemispherical cap packaging insert in the shipping and packaging position.

The invention is a cap packaging insert 10. The cap packaging insert 10 includes a supporting, sufficiently rigid, crown portion 12 shaped and sized to follow the inner surface contours of the front portion 14 of a baseball type cap crown. The cap packaging insert fits within the front portion of the baseball type cap crown 18. It is retained within the baseball type cap by inserting it into or around the baseball type cap sweatband. During packaging and shipping the cap packaging insert retains the shape of the front portion of the baseball type cap crown. The supporting, sufficiently rigid, crown portion has an inner surface 22 and an outer surface 26, a lower peripheral edge 30 and an aft peripheral edge 34.

In another variation on the invention the supporting, sufficiently rigid, crown portion of essentially a half-hemispherical shape 12 can be fabricated from plastic, acrylic, polyvinyl chloride (PVC), polyethylene terephthalate (PET), polystyrene (PS), propylene and poly propylene (PP), or cardboard.

Yet another variation on the invention uses an injection mode as a means to manufacture the supporting, sufficiently rigid, crown portion of essentially a half-hemispherical shape 12.

Still another variation on the invention uses a press mode as a means to manufacture the supporting, sufficiently rigid, crown portion of essentially a half-hemispherical shape 12.

The cap packaging insert 42, in another version of the invention, includes a supporting, sufficiently rigid, crown portion 46 shaped and sized to follow the inner surface contours of the of a baseball type cap crown 50. The cap packaging insert fits within the baseball type cap crown portion. It is retained by inserting it into or around the baseball type cap sweatband. During packaging and shipping, the cap packaging insert retains the shape of the baseball type cap crown. The supporting, sufficiently rigid, crown portion 46 has an inner surface 58 and an outer surface 62, and a lower peripheral edge 66. The lower peripheral edge 66 has a circumferential linear extent of a first predetermined length.

A variation on this form of the invention has a means 68 of attaching supporting, sufficiently rigid, crown portion 46 to the essentially hemispherical crown portion of a baseball type cap 50.

In another variation on this form of the invention the supporting, sufficiently rigid, crown portion 46 can be fabricated from plastic, acrylic, polyvinyl chloride (PVC), polyethylene terephthalate (PET), polystyrene (PS), propylene and poly propylene (PP), or cardboard.

Yet another variation on this form of the invention uses an injection mode as a means to manufacture the supporting, sufficiently rigid, crown portion 46.

Still another variation on this form of the invention uses a press mode as a means to manufacture the supporting, sufficiently rigid, crown portion 46.

What is claimed is:

1. A cap packaging insert, comprising:

a cap packaging insert being provided, said cap packaging insert being shaped and sized to follow the inner surface contours of the front portion of a baseball cap crown and fit within said front portion o said baseball cap crown, said cap packaging insert being retained by inserting it around said baseball cap sweatband, said cap packaging insert being sufficiently rigid to retain the shape of said front portion of said baseball cap crown during packaging and shipping;

said cap packaging insert having an inner surface and an outer surface, a lower peripheral edge and an aft peripheral edge; and said cap packaging insert being fabricated from materials being selected from the group consisting of plastic, acrylic, Polyvinyl Chloride (PVC), Polyethylene Terephthalate (PET), polystyrene (PS), propylene and poly propylene (PP) or cardboard.

2. A cap packaging insert according to claim 1 wherein the method of manufacturing said cap packaging insert involves an injection mold.

3. A cap packaging insert according to claim 1 wherein the method of manufacturing said cap packaging insert involves a press mold.

4. A cap packaging insert, comprising:

a cap packaging insert being provided, said cap packaging insert being shaped and sized to follow the inner surface contours of a baseball cap crown and fit within said baseball cap crown, said cap packaging insert being retained by inserting it around said baseball cap sweatband, said cap packaging insert being sufficiently rigid to retain the shape of said baseball cap crown during packaging and shipping;

said cap packaging insert having an inner surface and an outer surface, a lower peripheral edge and an aft peripheral edge with a circumferential linear extent of a first predetermined length; and said cap packaging insert being fabricated from materials being selected from the group consisting of plastic, acrylic, Polyvinyl Chloride (PVC), Polyethylene Terephthalate (PET), polystyrene (PS), propylene and poly propylene (PP) or cardboard.

5. A cap packaging insert according to claim 4 wherein the method of manufacturing said cap packaging insert involves an injection mold.

6. A cap packaging insert according to claim 4 wherein the method of manufacturing said cap packaging insert involves a press mold.

* * * * *